US010130233B2

(12) United States Patent
Jang et al.

(10) Patent No.: US 10,130,233 B2
(45) Date of Patent: Nov. 20, 2018

(54) ROBOT CLEANER

(71) Applicant: SAMSUNG ELECTRONICS CO., LTD., Suwon-si, Gyeonggi-do (KR)

(72) Inventors: Jae Hwi Jang, Yongin-si (KR); Jin Sung Kim, Seoul (KR); Sin Ae Kim, Suwon-si (KR); Won kuk Kim, Seoul (KR); Young Jae Park, Suwon-si (KR); Hyo Won Sin, Anseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 438 days.

(21) Appl. No.: 14/547,418

(22) Filed: Nov. 19, 2014

(65) Prior Publication Data

US 2015/0143658 A1 May 28, 2015

(30) Foreign Application Priority Data

Nov. 25, 2013 (KR) ..... 10-2013-0143789
Aug. 6, 2014 (KR) ..... 10-2014-0101296

(51) Int. Cl.
*A47L 9/04* (2006.01)
*A47L 11/40* (2006.01)

(52) U.S. Cl.
CPC ..... *A47L 11/4044* (2013.01); *A47L 9/0444* (2013.01); *A47L 9/0461* (2013.01);
(Continued)

(58) Field of Classification Search
CPC ..... A47L 11/4044; A47L 11/4047; A47L 2201/00; A47L 9/0444
(Continued)

(56) References Cited

U.S. PATENT DOCUMENTS 1,209,720 A * 12/1916 Kirby ..... A47L 11/4038 15/385
2,524,928 A * 10/1950 Platz ..... A47L 11/14 15/320

(Continued)

FOREIGN PATENT DOCUMENTS

CN 2096966 U 2/1992
CN 1103281 A 6/1995

(Continued)

OTHER PUBLICATIONS

Computer generated English translation of DE 10 2010 000 577 A1, Aug. 2011, Meyer.*

(Continued)

*Primary Examiner* — Laura C Guidotti
(74) *Attorney, Agent, or Firm* — Staas & Halsey LLP

(57) ABSTRACT

A robot cleaner that sweeps dust on the floor toward its center and absorbs the dust through a small-area inlet with a strong suction force, by a cleaning tool that integrates functions of side brushes and a main brush into one. The present disclosure also provides a robot cleaner that enables a large-diameter foreign material to be guided to and effectively absorbed through the inlet without interference by a cleaning tool. The robot cleaner includes a main unit including a fan motor and a dust collector and having an inlet arranged on a base to absorb foreign materials, and a cleaning tool arranged in the bottom of the base, extending to a front side of the base from the inlet and guiding a foreign material on a floor to a side of the inlet, wherein the cleaning tool is arranged to be movable by an external force.

43 Claims, 14 Drawing Sheets

(52) U.S. Cl.
CPC ..... *A47L 9/0477* (2013.01); *A47L 11/4013* (2013.01); *A47L 11/4041* (2013.01); *A47L 11/4047* (2013.01); *A47L 11/4069* (2013.01); *A47L 2201/00* (2013.01)

(58) Field of Classification Search
USPC ..... 15/374, 384–385, 22.3, 80, 99, 401
See application file for complete search history.

(56) References Cited

U.S. PATENT DOCUMENTS

| | | | | |
|---|---|---|---|---|
| 2,876,484 | A * | 3/1959 | Wells | A47L 7/0009 15/246.4 |
| 5,918,346 | A * | 7/1999 | Suzuki | A47L 11/4044 15/320 |
| 2005/0166356 | A1* | 8/2005 | Uehigashi | A47L 5/30 15/319 |
| 2009/0089962 | A1* | 4/2009 | Vanderlinden | E01H 1/042 15/340.1 |
| 2012/0084938 | A1 | 4/2012 | Fu | |
| 2014/0130294 | A1 | 5/2014 | Li et al. | |
| 2014/0137367 | A1* | 5/2014 | Li | A47L 11/4058 15/383 |

FOREIGN PATENT DOCUMENTS

| | | | | |
|---|---|---|---|---|
| CN | 1833594 | A | 9/2006 | |
| CN | 2822497 | Y | 10/2006 | |
| CN | 2918530 | Y | 7/2007 | |
| DE | 690 09 665 | T2 | 10/1994 | |
| DE | 10 2010 000 577 | A1 * | 8/2011 | A47L 9/0494 |
| EP | 2 604 163 | A2 | 6/2013 | |
| EP | 2 702 918 | B1 | 12/2016 | |
| JP | 2011-45694 | | 3/2011 | |
| JP | 3182828 | | 3/2013 | |
| KR | 2003-0085165 | | 11/2003 | |
| KR | 10-2006-0042801 | | 5/2006 | |
| KR | 10-2007-0107956 | | 11/2007 | |
| KR | 10-2009-0078610 | | 7/2009 | |
| KR | 10-2012-0087727 | | 8/2012 | |
| WO | WO 2012/147669 | A1 | 11/2012 | |

OTHER PUBLICATIONS

International Search Report dated Feb. 25, 2015 in corresponding International Patent Application No. PCT/KT2014/011316.
Australian Office Action dated Apr. 3, 2017, in corresponding Australian Patent Application No. 2014353715.
Australian Notice of Acceptance of Patent Application dated Jul. 24, 2017, in corresponding Australian Patent Application No. 2014353715.
Extended European Search Report dated Dec. 14, 2017, in corresponding European Patent Application No. 14864297.8.
Chinese Office Action dated Mar. 30, 2018, in corresponding Chinese Patent Application No. 20140064385.6.

* cited by examiner

ROBOT CLEANER

CROSS-REFERENCE TO RELATED APPLICATION(S)

This application claims the benefit under 35 U.S.C. § 119(a) of a Korean patent applications filed on Nov. 25, 2013 and Aug. 6, 2014 in the Korean Intellectual Property Office and assigned Serial Nos. 10-2013-0143789 and 10-2014-0101296, the entire disclosures of which are incorporated hereby incorporated by reference.

TECHNICAL FIELD

The present disclosure relates to a robot cleaner with improved cleaning efficiency.

BACKGROUND

Robot cleaners are devices for doing the cleaning work by absorbing foreign materials like dust from the floor while driving a cleaning area itself without any help from a user. They clean the area while turning their course, by determining a distance to an obstacle like furniture, office equipment, walls, etc. in the cleaning area and driving left-wheel and right-wheel motors selectively.

The robot cleaner has an inlet on its bottom to absorb dust on the floor. On the side of the inlet, a main brush is rotationally mounted to pick up dust on the floor. Side brushes may further be included in the robot cleaner. They are attached to either side of the front of the robot cleaner, sweeping dust or things, out of reach to the main brush, toward the center. The dust or things swept by the side brushes toward the center may be picked up by the main brush and absorbed through the inlet. Such side brushes may expand the cleaning area of the robot cleaner.

SUMMARY

The present disclosure provides a robot cleaner that sweeps dust on the floor toward its center and absorbs the dust through a small-area inlet with a strong suction force.

The present disclosure also provides a robot cleaner that enables a large-diameter foreign material to be guided to and effectively absorbed through the inlet without interference by a cleaning tool.

In accordance with an aspect of the present disclosure, a robot cleaner is provided. The robot cleaner includes a main unit including a fan motor and a dust collector and having an inlet arranged in the bottom of the main unit; and a cleaning tool arranged in the bottom of the main unit, extending to a front side of the main unit from a side of the inlet and guiding a foreign material on a floor to the inlet.

The cleaning tool may have one end located on the side of the inlet and the other end located at a point adjacent to the outer circumference of the main unit.

The cleaning tool may be arranged to be movable by an external force.

The inlet may include a door, which moves in sync with the cleaning tool.

If a side of the cleaning tool moves toward an outer side of the bottom of the main unit, the door may move with the cleaning tool to expand the inlet.

The cleaning tool may include a first cleaning tool that extends from a side of the inlet to a left front side of the main unit to guide foreign materials on the floor to the inlet; and a second cleaning tool that extends from a side of the inlet to a right front side of the main unit to guide foreign materials on the floor to the inlet.

The cleaning tool may be a brush assembly including a belt with a brush attached thereto.

The brush assembly may include a first pulley arranged on a side of the inlet and a second pulley arranged on a front side of the main unit, and the belt may be rotated while being wound around the first and second pulleys.

The belt may include a first part located on a side of the center of the main unit and a second part located on an opposite side of the center of the bottom and the belt may be rotated for the first part to move from the front of the main unit to the inlet.

The belt may be arranged to be tilted for the second part not to be in contact with the floor.

Belt contacts of the first and second pulleys may each be arranged to be tilted at an angle to face an outer side of the main unit.

A part of the brush attached to the belt may be located inside the inlet.

The cleaning tool may be formed of a flexible rubber material.

An outer face of the blade may be coated or has irregularities in order to easily capture foreign materials on the floor.

A slit may be formed on the bottom face of the main unit, which is located above the blade, for air discharged from the dust collector to pass through.

The cleaning tool comprises a roller brush with a spiral brush attached onto the outer circumference of the cleaning tool.

The inlet has a suction path partitioned by a guide to smoothly absorb foreign materials gathered by the cleaning tool.

In accordance with another aspect of the present disclosure, a robot cleaner is provided. The robot cleaner includes: a main unit having an inlet through which foreign materials on a floor is absorbed; a fan motor arranged in the main unit for producing a suction force; a dust collector for separating and keeping foreign materials contained in air absorbed through the inlet; and multiple cleaning tools arranged on the bottom of the main unit for guiding foreign materials on the floor to the inlet, wherein a shortest distance between a cleaning tool and an adjacent cleaning tool gets farther as the two cleaning tools is farther away from the inlet.

One ends of the two cleaning tools may be arranged to be farther away by an external force.

The cleaning tool is arranged to be rotated around a rotation axis located on the other end of the cleaning tool.

The inlet may include a door, which moves in sync with the cleaning tool.

An area of the inlet may be expanded or reduced by the door.

The main unit may include an elastic member to apply an elastic force to the cleaning tool, and if the external force applied to the cleaning tool disappears, the distance between one ends of the two cleaning tools may return to an original state due to the elastic member.

The cleaning tool may include a first cleaning tool having one end located on a side of the inlet and the other end extending to be located on a right front side of the main unit; and a second cleaning tool having one end located on a side of the inlet and the other end extending to be located on a left front side of the main unit.

The first and second cleaning tools may be arranged to be symmetrical to each other.

In accordance with another aspect of the present disclosure, a robot cleaner is provided. The robot cleaner includes: a main unit including a fan motor and a dust collector and having an inlet arranged in the bottom of the main unit; and a cleaning tool arranged on the bottom of the main unit for picking up and guiding foreign materials on a floor to the inlet, wherein the cleaning tool includes a first cleaning tool extending from a side of the inlet to a right front side of the main unit and a second cleaning tool extending from a side of the inlet to a left front side of the main unit, and wherein the first and second cleaning tools are arranged to be rotated around a rotation axis by being pressed by a foreign material that lies between the first and second cleaning tools.

The inlet may include a door, which expands or reduces an area of the inlet by moving in sync with the first or second cleaning tool.

The door may expand an open area of the inlet if the cleaning tool is pressed and rotated around the rotation axis in one direction.

The robot cleaner may further include an elastic member for applying an elastic force to the cleaning tool to rotate in the other direction if an external force applied to the cleaning tool disappears.

The cleaning tool may include a brush assembly having a brush attached onto the outer circumference of a belt.

The belt may be arranged to be tilted such that a part of the brush assembly that moves from the rear to the front does not contact the floor surface.

The cleaning tool may include a roller brush with a spiral brush attached onto the outer circumference of the cleaning tool.

Other aspects, advantages, and salient features of the disclosure will become apparent to those skilled in the art from the following detailed description, which, taken in conjunction with the annexed drawings, discloses exemplary embodiments of the disclosure

BRIEF DESCRIPTION OF THE DRAWINGS

The above and other features and advantages of the present disclosure will become more apparent by describing in detail exemplary embodiments thereof with reference to the attached drawings in which.

Throughout the drawings, like reference numerals will be understood to refer to like parts, components, and structures.

DETAILED DESCRIPTION

Figure 1:
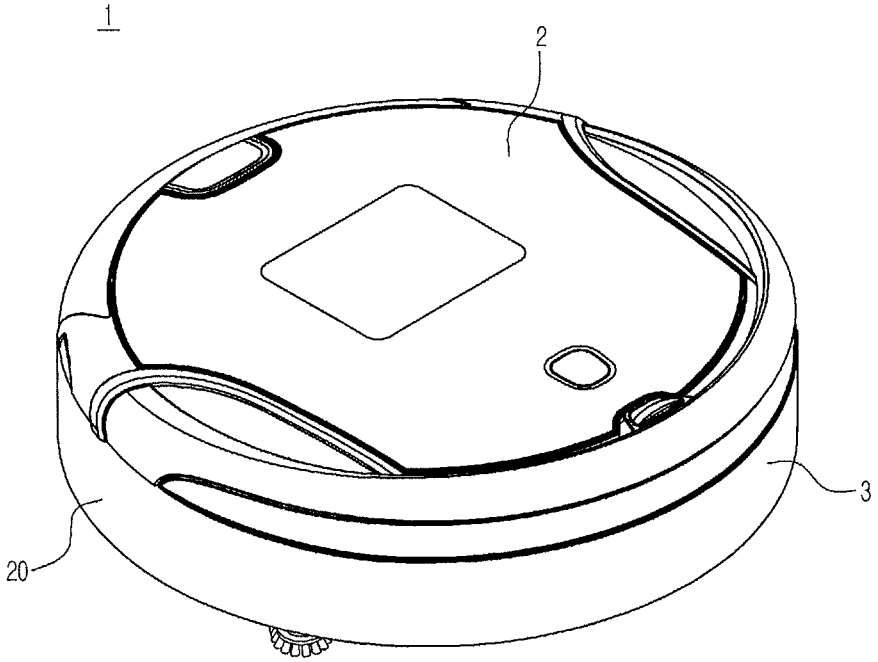
FIG. 1 shows a robot cleaner according to an embodiment of the present disclosure.

The present disclosure will now be described more fully with reference to the accompanying drawings, in which exemplary embodiments of the disclosure are shown. The disclosure may, however, be embodied in many different forms and should not be construed as being limited to the embodiments set forth herein; rather, these embodiments are provided so that this disclosure will be thorough and complete, and will fully convey the concept of the disclosure to those skilled in the art. Like reference numerals in the drawings denote like elements, and thus their description will be omitted. In the description of the present disclosure, if it is determined that a detailed description of commonly-used technologies or structures related to the embodiments of the present disclosure may unnecessarily obscure the subject matter of the invention, the detailed description will be omitted. It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section.

Embodiments of a robot cleaner in accordance with the present disclosure will now be described with reference to accompanying drawings.

Figure 2:
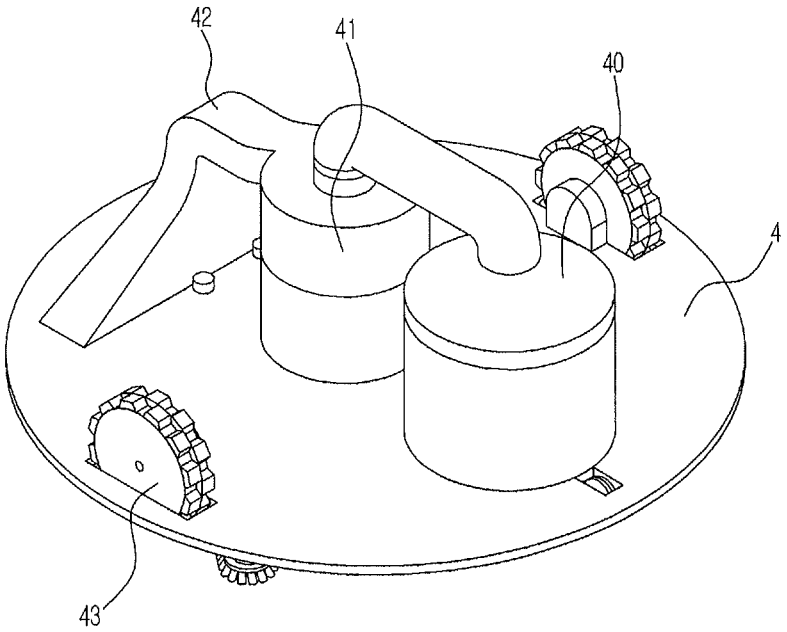
FIG. 2 shows a main unit of a robot cleaner according to an embodiment of the present disclosure.

FIG. 1 shows a robot cleaner according to an embodiment of the present disclosure; FIG. 2 shows a main unit of a robot cleaner according to an embodiment of the present disclosure; and FIG. 3 shows brushes arranged on the bottom of a robot cleaner according to an embodiment of the present disclosure.

Figure 3:
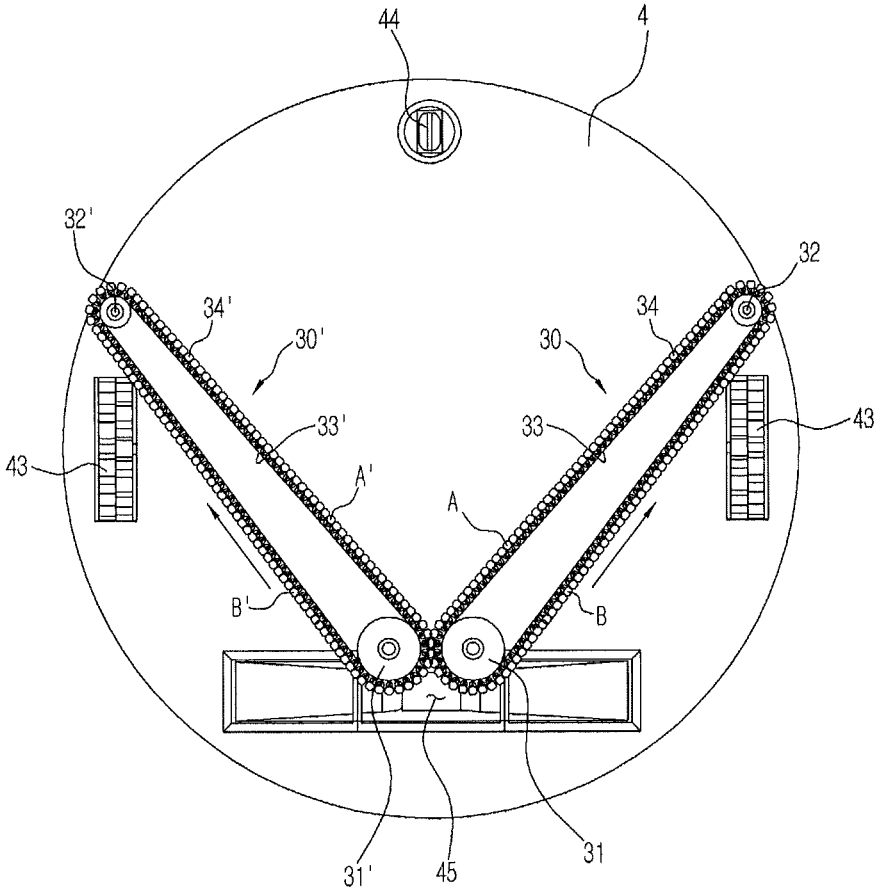
FIG. 3 shows brushes arranged on the bottom of a robot cleaner according to an embodiment of the present disclosure.

Referring to FIGS. 1 to 3, a robot cleaner 1 in accordance with an embodiment of the present disclosure includes a cover 2 and a main unit 3. The cover 2 may cover the top of the main unit 3. A bumper 20 is arranged around the side of the robot cleaner 1. The bumper 20 may soften external shocks applied to the robot cleaner 1. Sensors (not shown) may be arranged around the side of the robot cleaner 1 to detect obstacles around the robot cleaner 1.

The robot cleaner 1 may run on wheels 43. The wheels 43 may be arranged on left and right sides of the robot cleaner 1. Specifically, if the bottom of the robot cleaner 1 is round in shape, the wheels 43 may be arranged on the left and right sides to the center of the robot cleaner 1. The wheels 43 may be driven by motors. The wheels 43 may rotate clockwise or counterclockwise to run the robot cleaner 1 in various directions.

On the bottom of the robot cleaner 1, a caster 44 able to run in all directions may be further arranged. The caster 44 may be arranged on the front or rear side of the robot cleaner 1. The bottom part of the robot cleaner 1 may be reliably supported by two wheels 43 and one or more casters 44. Due to the caster 44 able to run in all directions, changes in direction of the robot cleaner 1 may be smoothly made.

The main unit 3 may include a fan motor 40, a dust collector 41, and a suction path 42. The main unit 3 may also include a base 4 on which the fan motor 40, dust collector 41, and suction path 42 may be installed. An inlet 45 may be formed in the base 4. The dust collector 41 and the inlet 45 formed in the base 4 are connected via the suction path 42.

The fan motor 40 produces a suction force. Foreign materials contained in the air absorbed by the fan motor 40 may be received by the dust collector 41. The foreign materials absorbed through the inlet 45 may be separated from the air while passing through the dust collector 41 and kept in the dust collector 41. The air from which the foreign materials are separated off may be released from the dust collector 41.

As the dust collector 41, a cyclone dust collector may be used. The cyclone dust collector 41 separates foreign materials from the air with centrifugal force by generating a swirling stream. The air with the foreign materials separated off may be released to the outside and the foreign materials are collected in the dust collector 41. If the foreign materials have been collected to some extent, the user may separate the dust collector 41 from the robot cleaner 1 and threw away the foreign materials.

Cleaning tools are arranged on the bottom face of the base 4. The cleaning tools may include a first cleaning tool having an end located on the side of the inlet 45 and the other end extending to a right front side of the base 4 and a second cleaning tool having an end located on a side of the inlet 45 and the other end extending to a left front side of the base 4. The other ends of the first and second cleaning tools may be arranged to be apart to the greatest extent from each other. For example, the shortest distance between the other ends of the first and second cleaning tools may be equal to or close to a diameter of the base 4.

The cleaning tools may be brush assemblies 30 and 30' arranged in a conveyor belt style. The brush assemblies 30 and 30' may pick up foreign materials on the floor and sweep them toward the inlet 45 formed on the base 4. The foreign materials swept toward the inlet 45 may be absorbed with suction force of the fan motor 40 through the suction path 45 to the dust collector 41.

The brush assemblies 30 and 30' may include first and second brush assemblies 30 and 30'. One ends of the first and second brush assemblies 30 and 30' may be arranged to be adjacent to each other while the other ends of them are arranged to be apart from each other. The first and second assemblies 30 and 30' may be arranged in the shape of V.

One ends of the first and second assemblies 30 and 30' may be located on the side of the inlet 45. The other ends of them may be arranged to be apart from each other to the greatest extent to the outer circumference of the base 4. That is, the other ends of the first and second assemblies 30 and 30' may be located to be apart from each other to the greatest extent to the left and right directions. Arranging them to be apart from each other to the greatest extent may lead to widening an area from which foreign materials may be picked up by the brush assemblies 30 and 30'.

For example, the other ends of the brush assemblies 30 and 30' may be located in the front or back of the wheels 43. That is, the brush assemblies 30 and 30' may extend from around the suction part 45 to the front or back of the wheels 43.

The first brush assembly 30 may include pulleys 31 and 32 connected to motors, and a belt 33. The pulleys 31 and 32 include first and second pulleys 31 and 32. The first pulley 31 may be arranged on the side of the inlet 45 formed on the base 4. The second pulley 32 may be arranged to be close to a right point of the outer circumference of the base 4 on the bottom face of the base 4. The second pulley 32 may be located to be close to a point where the diameter extending both to the left and right on the bottom of the base 4 meets the outer circumference of the base 4. The belt 33 may be wound around the first and second pulleys 31 and 32.

The belt 33 may be formed of an elastic rubber material. A brush 34 may be attached around the outer edges of the belt 33. The brush 34 may be attached along the direction in which the belt 33 extends. When the belt 33 is rotated by the pulleys 31 and 32, the brush 34 may pick up foreign materials on the floor and guide them toward the inlet 45 while moving in sync with the belt 33.

The pulleys 31 and 32 may be rotated counterclockwise by motors. When the pulleys 31 and 32 are rotated counterclockwise by the motors, the belt 33 may be rotated counterclockwise by the pulleys 31 and 32.

If a part of the belt 33 located on inner side of the base 4 from the pulleys 31 and 32 is referred to as a first part A and a part outer side of the base 4 from the pulleys 31 and 32 is referred to as a second part B, the first part A may move from front to back of the robot cleaner 1 and the second part B may move from back to front of the robot cleaner 1.

Specifically, the first part A may move from the front of the robot cleaner 1 toward the inlet 45, and the second part B may move from the side of the inlet 45 toward the front of the robot cleaner 1. Foreign materials on the floor may be picked up by the brush 34 on the first part A and guided toward the inlet 45. The foreign materials guided to the inlet 45 may be absorbed with a suction force of the fan motor 40 through the suction path 45 to the dust collector 41.

Similarly, the second brush assembly 30' may include pulleys 31' and 32' connected to motors, and a belt 33'. The pulleys 31' and 32' include first and second pulleys 31' and 32'. The first pulley 31' may be arranged on the side of the inlet 45 formed on the base 4. The second pulley 32' may be arranged to be close to the outer circumference of the base 4 on the left of the bottom face of the base 4. The second pulley 32' may be located to be close to a point where the diameter extending both to the left and right on the bottom of the base 4 meets the outer circumference of the base 4. The second pulleys 32 and 32' of the first and second brush assemblies 30 and 30' may be located to be apart to the greatest extent from each other on the bottom face of the base 4. The belt 33' may be wound around the first and second pulleys 31' and 32'.

The belt 33' may be formed of an elastic rubber material. A brush 34' may be attached around the outer edges of the belt 33'. The brush 34' may be attached along the direction in which the belt 33' extends. When the belt 33' is rotated by the pulleys 31' and 32', the brush 34' may pick up foreign materials on the floor and guide them toward the inlet 45 while moving in sync with the belt 33'.

The pulleys 31' and 32' may be rotated clockwise by motors. When the pulleys 31' and 32' are rotated clockwise, the belt 33' may be rotated clockwise by the pulleys 31' and 32'.

If a part of the belt 33' located on inner side of the base 4 from the pulleys 31' and 32' is referred to as a first part N and a part outer side of the base 4 from the pulleys 31' and 32' is referred to as a second part B', the first part N may move from front to rear of the robot cleaner 1 and the second part B' may move from back to front of the robot cleaner 1.

Specifically, the first part N may move from the front of the robot cleaner 1 to the inlet 45, and the second part B' may move from the side of the inlet 45 to the front of the robot cleaner 1. Foreign materials on the floor may be picked up by the brush 34 on the first part N and guided toward the inlet 45. The foreign materials guided to the inlet 45 may be absorbed with a suction force of the fan motor 40 through the suction path 45 to the dust collector 41.

The embodiment of the robot cleaner 1 has the first and second brush assemblies 30 and 30' rotated counterclockwise and clockwise, respectively, but they may be rotated clockwise and counterclockwise, respectively, in another embodiment. If the first brush assembly 30 is rotated clockwise, foreign materials on the floor may be picked up and guided by the second part B to the inlet 45. If the second brush assembly 30' is rotated counterclockwise, foreign materials on the floor may be picked up and guided by the second part B' toward the inlet 45. Arranging the first parts A and N of the first and second brush assemblies 30 and 30' to pick up foreign materials on the floor is beneficial to reducing the size of the inlet 45. An occasion where the first brush assembly 30 has the first part A pick up foreign materials on the floor while being rotated counterclockwise and the second brush assembly 30' has the first part A' pick up foreign materials on the floor while being rotated clockwise will now be described.

Figure 4:
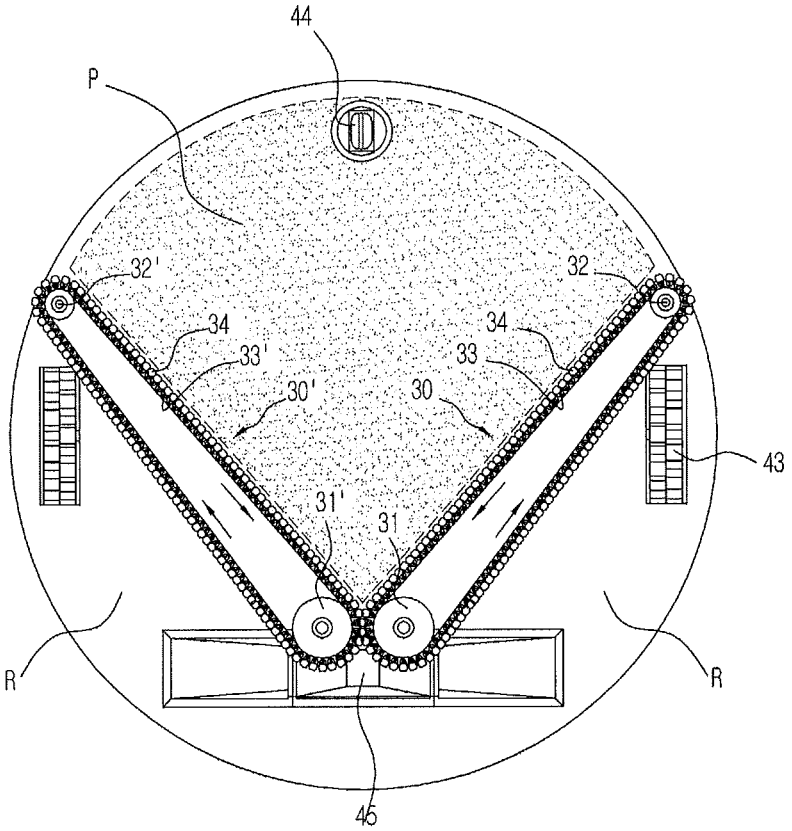
FIG. 4 shows a dust pickup section of a robot cleaner according to an embodiment of the present disclosure.

FIG. 4 shows a dust pickup section of a robot cleaner according to an embodiment of the present disclosure.

Referring to FIG. 4, the robot cleaner 1 may clean a wide area by means of the brush assemblies 30 and 30'. Foreign materials on the floor ahead P of the running robot cleaner 1 may be picked up and guided by the brush assemblies 30 and 30' arranged in the shape of 'V' toward the inlet 45.

In case of a conventional robot cleaner, wheels are located on both sides of the robot cleaner. The wheels are arranged on the left and right sides from the center of the robot cleaner for reliable running. A roller brush is installed on the side of the inlet that is located in the front or back of the robot cleaner, to pick up foreign materials on the floor. The inlet and brush are located in the front or back of the robot cleaner not to be interfered with by the wheels.

The conventional robot cleaner cleans the floor by picking up foreign materials on the floor corresponding to the length of the roller brush and absorbing them through the inlet. If the robot cleaner has a round shape, the length of the roller brush extending in left and right directions is shorter than the diameter of the robot cleaner. Accordingly, an area of the floor to be cleaned by the roller brush is smaller than an area of the floor passed by, while the robot cleaner is running.

To improve cleaning efficiency of the robot cleaner, side brushes are installed in the front of the robot cleaner. The side brushes serve to sweep foreign materials to the center of the robot cleaner while being rotated. Contaminants having a large mass and slick surface may be effectively swept by the side brushes toward the center of the robot cleaner, but an object having a small mass and large volume, such as dust or hair may be stuck to the side brushes and thus rather degrade cleaning performance. Furthermore, the side brushes often thrust the dust on the floor away to the outside of the robot cleaner. Sometimes, the side brush happens to be stuck to an obstacle and thus prevents the robot cleaner from running.

In contrast, the robot cleaner 1 in accordance with an embodiment of the present disclosure has a round shape and has brush assemblies 30 and 30' arranged to extend in the shape of 'V' on the bottom face, thereby picking up foreign materials in a wide area of the floor. The belts 33 and 33' are wound around the first pulleys 31 and 31' located on the side of the inlet 45 and the second pulleys 32 and 32' located to be adjacent to the left and right points of a diameter of the robot cleaner 1, and the brushes 34 and 34' attached to the belts 33 and 33' may pick up foreign materials on the floor. With the belts 33 and 33', to which the brushes 34 and 34' are attached, extending to be adjacent to left and right points of a diameter of the robot cleaner 1, an area of the floor from which foreign materials are picked up by the brush assemblies 30 and 30' may be close to an area of the floor that the running robot cleaner 1 passes by. As such, compared to the conventional robot cleaner, the robot cleaner 1 in accordance with embodiments of the present invention may do cleaning by picking up foreign materials in a wide area of the floor. The foreign materials picked up by the first parts A and N of the brush assemblies 30 and 30' may be guided to the inlet 45 and absorbed into the dust collector 41.

Since foreign materials are guided by the V-shaped cleaning tool to the inlet 45, the area of the inlet 45 may be smaller than those of conventional robot cleaners. As the area of the inlet decreases, the inlet may exert greater suction force generated by the same fan motor. In other words, since the inlet may exert greater suction force without a high power motor, robot cleaners with better cleaning performance may be manufactured without increasing manufacturing costs.

The inlet 45 may be formed to have a wider area than the cross section area of the suction path 42, such that the cleaning tool absorbs fine dust floating in the outer area R of the cleaning tool.

Figure 5:
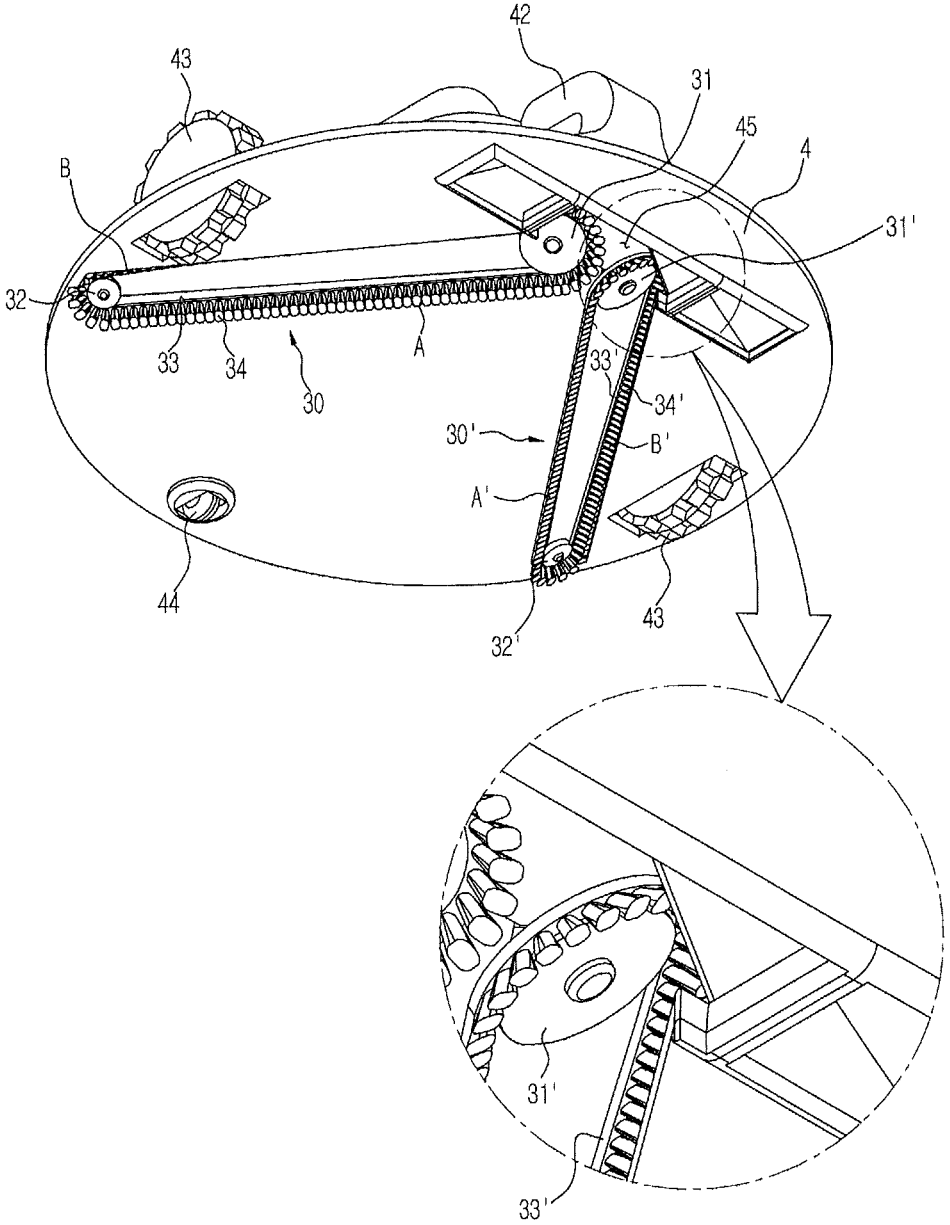
FIG. 5 shows a brush assembly tilted in the robot cleaner according to an embodiment of the present disclosure.

FIG. 5 shows a brush assembly tilted in the robot cleaner according to an embodiment of the present disclosure.

Referring to FIG. 5, the robot cleaner 1 may have the brush assemblies 30 and 30' tilted not to interfere with running of the robot cleaner 1. The brush assemblies 30 and 30' may be tilted such that a part that interferes with running of the robot cleaner 1 does not contact the floor.

The first brush assembly 30 may be rotated counterclockwise. The first part A of the first brush assembly 30 moves from the front to the rear of the robot cleaner 1. A frictional force that pushes the floor back to move the robot cleaner 1 forward is produced between the first part A and the floor surface. On the other hand, the second part B produces a frictional force on the floor that moves the robot cleaner 1 backward while moving from the rear to the front of the robot cleaner 1. The frictional force between the second part B and the floor surface interferes with running of the robot cleaner 1. In addition, the second part B may not serve well to pick up and guide foreign materials to the inlet 45 but push them outside of the robot cleaner 1.

The first and second pulleys 31 and 32 may be installed such that their belt contacts, around which the belt 33 is wound and makes contacts, are tilted at certain angles for the second part B not to make a contact with the floor surface. For example, the belt contacts of the first and second pulleys 31 and 32 may be tilted at certain angles to look outside of the robot cleaner 1. The belt 33 wound around the first and second pulleys 31 and 32 may be tilted at the tilting angles of the pulleys 31 and 32. The first part A of the first brush assembly 30 picks up and guides foreign materials to the inlet 45 while being in contact with the floor surface. The second part B of the first brush assembly 30 is spaced apart from the floor and thus does not interfere with running of the robot cleaner 1. As such, the robot cleaner 1 may run smoothly.

In this regard, the belt contact of the first pulley 31 is arranged to be tilted at a certain angle toward the outside of the robot cleaner 1, so that a part of the brush 34 around the first pulley 31 may come into the inlet 45. The fact that a part of the brush 34 comes into the inlet 45 may improve performance of separating foreign materials stuck to the brush 34 with suction force of the fan motor 40.

Similarly, the second brush assembly 30' may be rotated clockwise. The first part N of the second brush assembly 30' moves from the front to the rear of the robot cleaner 1. A frictional force that pushes the floor back to move the robot cleaner 1 forward is produced between the first part N and the floor surface. On the other hand, the second part B' produces a frictional force on the floor that moves the robot cleaner 1 backward while moving from the rear to the front of the robot cleaner 1. The frictional force between the second part B' and the floor surface interferes with running of the robot cleaner 1. In addition, the second part B' may not serve well to pick up and guide foreign materials to the inlet 45 but push them outside of the robot cleaner 1.

The first and second pulleys 31' and 32' may be installed such that their belt contacts, around which the belt 33' is wound and makes contacts, are tilted at certain angles for the second part B' not to make a contact with the floor surface.

For example, the belt contacts of the first and second pulleys 31' and 32' may be tilted at certain angles to look outside of the robot cleaner 1. The belt 33' wound around the first and second pulleys 31' and 32' may be tilted at the tilting angles of the pulleys 31' and 32'. The first part N of the second brush assembly 30' picks up and guides foreign materials to the inlet 45 while being in contact with the floor surface. The second part B' of the second brush assembly 30' is spaced apart from the floor and thus does not interfere with running of the robot cleaner 1. As such, the robot cleaner 1 may run smoothly.

In this regard, the belt contact of the first pulley 31' is arranged to be tilted at a certain angle toward the outside of the robot cleaner 1, so that a part of the brush 34' around the first pulley 31' may come into the inlet 45. The fact that a part of the brush 34' comes into the inlet 45 may improve performance of separating foreign materials stuck to the brush 34 with suction force of the fan motor 40.

As such, enabling the parts of the brush assemblies 30 and 30' that interfere with running of the robot cleaner 1 to be rotated without making contacts with the floor may allow the robot cleaner to run smoothly without an increase in power required for running. Cleaning efficiency may also be improved by preventing the brush assemblies 30 and 30' from pushing foreign materials on the floor outside of the robot cleaner 1. The fact that parts of the brushes 34 and 34' come into the inlet 45 may lead to improvement of performance of separating foreign materials stuck to the brushes 34 and 34' with suction force of the fan motor 40.

Figure 6:
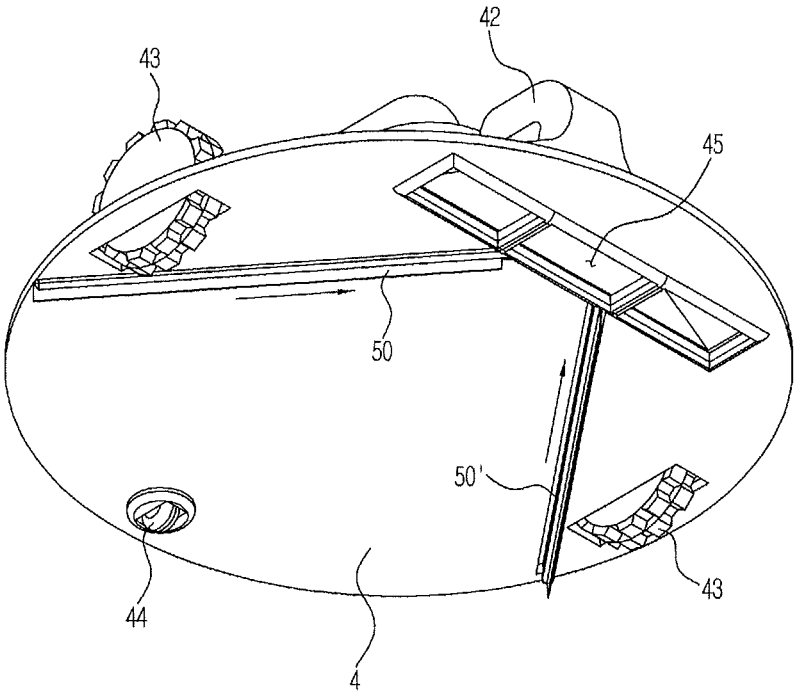
FIG. 6 shows blades arranged on the bottom of a robot cleaner according to an embodiment of the present disclosure.
Figure 7:
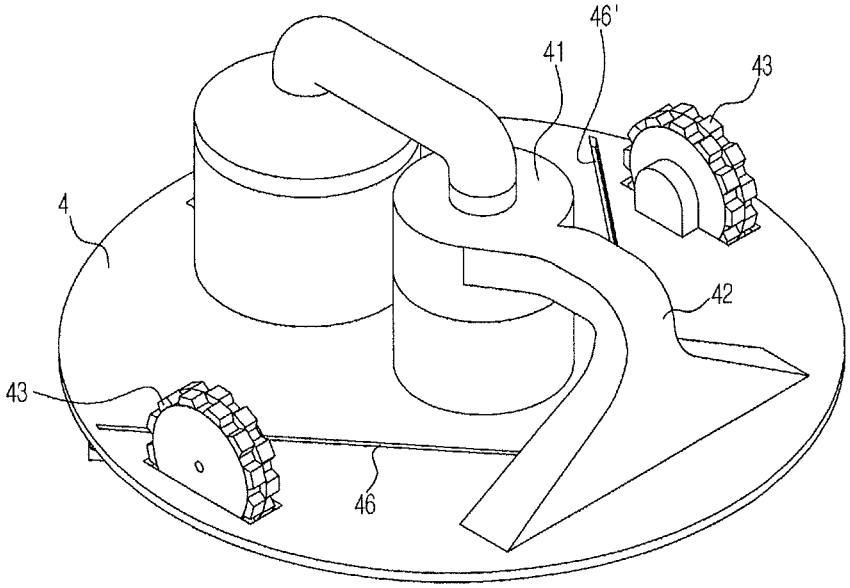
FIG. 7 shows slits formed on the top of a base of a robot cleaner according to an embodiment of the present disclosure.

FIG. 6 shows blades arranged on the bottom of a robot cleaner according to an embodiment of the present disclosure, and FIG. 7 shows slits formed on the top of a base of a robot cleaner according to an embodiment of the present disclosure.

Referring to FIGS. 6 and 7, cleaning tools arranged in the bottom of the robot cleaner 1 in accordance with an embodiment of the present disclosure may be blades 50 and 50'. The blades 50 and 50' include first and second blades 50 and 50'. One ends of the first and second blades 50 and 50' may be located on the side of the inlet 45. The other ends of the first and second blades 50 and 50' may be located to be apart from each other to the greatest extent to the left and right directions. For example, the other ends of the first and second blades 50 and 50' each may be located near a point where a diameter of the base 4 extending in left and right directions meets the outer circumference of the base 4. With this, the first and second blades 50 and 50' may be arranged in the shape of 'V' to be further apart from each other as they extend toward the front from a rear part where the inlet 45 is located.

The blades 50 and 50' may be made of a flexible material. For example, the blades 50 and 50' may be formed of rubber. The surface of each of the blades 50 and 50' may be coated or has irregularities in order to easily capture foreign materials on the floor.

As the robot cleaner 1 runs forward, foreign materials on the floor inside of the blades 50 and 50' including the center of the base 4 may be guided by the blades 50 and 50' to the inlet 45. The foreign materials guided to the inlet 45 may be absorbed with a suction force of the fan motor 40.

Slits 46 may be formed in the base 4. Specifically, the slits 46 may be formed at positions corresponding to where there are the blades 50 and 50'. Air discharged from the dust collector 42 of the robot cleaner 1 may be delivered to the inside of the blades 50 and 50' through the slits 46. The air delivered to the inside of the blades 50 and 50' may move foreign materials within the inside of the blades 50 and 50' toward the inlet 45 while flowing across the inside of the blades 50 and 50'. As such, foreign materials on the floor may be smoothly swept to and absorbed by the inlet 45.

Figure 8:
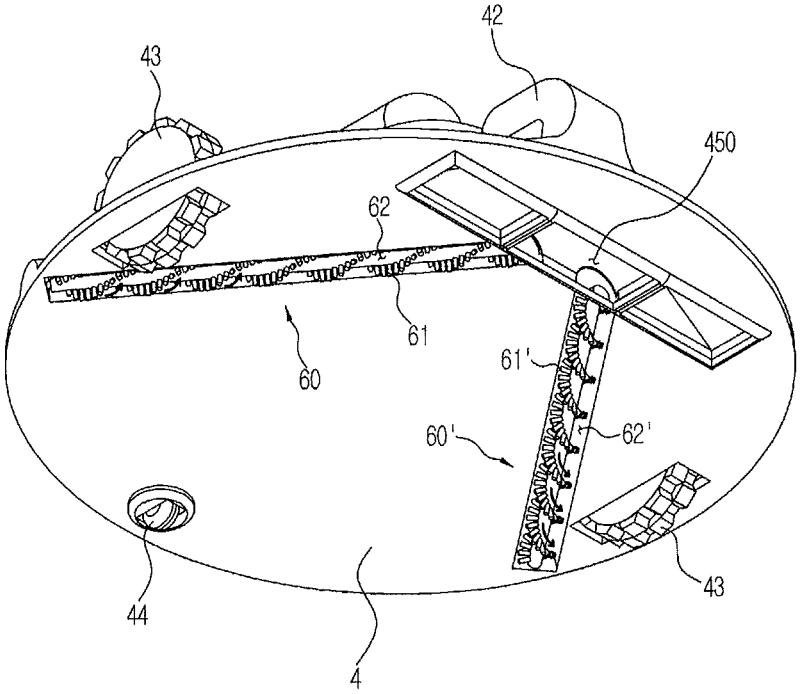
FIG. 8 shows roller brushes arranged on the bottom of a robot cleaner according to an embodiment of the present disclosure.

FIG. 8 shows roller brushes arranged on the bottom of a robot cleaner according to an embodiment of the present disclosure.

Referring to FIG. 8, cleaning tools arranged in the robot cleaner 1 in accordance with an embodiment of the present disclosure may be roller brushes 60 and 60'. The roller brushes 60 and 60' include first and second roller brushes 60 and 60'. One ends of the first and second roller brushes 60 and 60' may be located on the side of the inlet 45. The other ends of the first and second roller brushes 60 and 60' may be located to be apart from each other to the greatest extent to the left and right directions. For example, the other ends of the first and second roller brushes 60 and 60' each may be located near a point where a diameter of the base 4 extending in left and right directions meets the outer circumference of the base 4. With this, the first and second roller brushes 60 and 60' may be arranged in the shape of 'V' to be further apart from each other as they extend toward the front from a rear part where the inlet 45 is located.

The roller brushes 60 and 60' may be arranged to rotate around a direction in which the roller brushes 60 and 60' extend. Brushes 61 and 61' may be spirally attached onto the outer circumference of the roller brushes 60 and 60', respectively. Suction paths 62 and 62' may be formed between adjacent brushes 61 and 61' in the spiral form, to deliver suction force of the fan motor 40 to the other ends of the roller brushes 60 and 60'. Foreign materials floating by the brushes 61 and 61' may be shifted to the inlet 45 through the suction paths 62 and 62' formed between the adjacent spiral brushes 61 and 61'. As such, the roller brushes 60 and 60' may enable foreign materials on the floor to be smoothly swept to and absorbed by the inlet 45.

Figure 9:
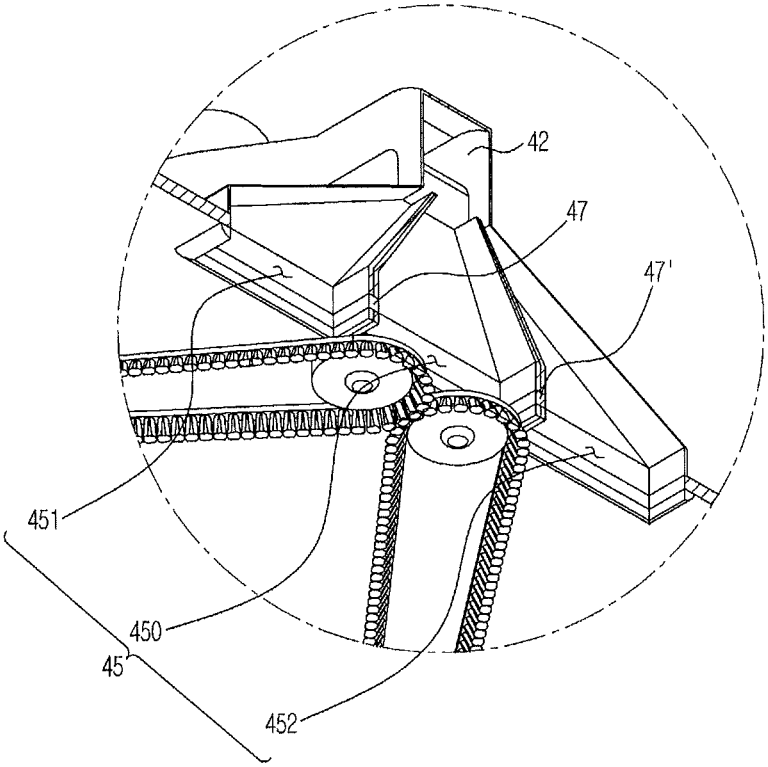
FIG. 9 shows a suction path of a robot cleaner according to an embodiment of the present disclosure.

FIG. 9 shows a suction path of a robot cleaner according to an embodiment of the present disclosure.

Referring to FIGS. 4 and 9, a suction path 42 of the robot cleaner 1 in accordance with an embodiment of the present disclosure may include guides 47 and 47'. The suction path to the inlet 45 may be partitioned by guides 47 and 47' into multiple paths. For example, the guides 47 and 47' may include a first guide 47 and a second guide 47'. The inlet 45 may be partitioned by the guides 47 and 47' into a first inlet 450, and second and third inlets 451 and 452, which are on the left and right of the first inlet 450.

The guides 47 and 47' may concentrate flux of the air to be absorbed through the inlet 45 at a particular section. For example, the guides 47 and 47' may be arranged for a greater flux of air to flow to the suction path 42 through the first inlet 450, if foreign materials are swept by the 'V' shaped cleaning tool to a center section of the inlet 45. In order for a greater flux of air to flow to the suction path 42 through the first inlet 450, the first inlet 450 may be formed to have the biggest opening. Foreign materials captured by the cleaning tool may be smoothly absorbed through the first inlet 450. Things like fine dust floating by and around the cleaning tool may be absorbed through the second and third inlets 451 and 452.

As described above, with the guides 47 and 47' arranged on the side of the inlet 45, suction force of the fan motor 40 may be concentrated at a center section of the inlet 45, thereby absorbing foreign materials more efficiently.

Figure 10:
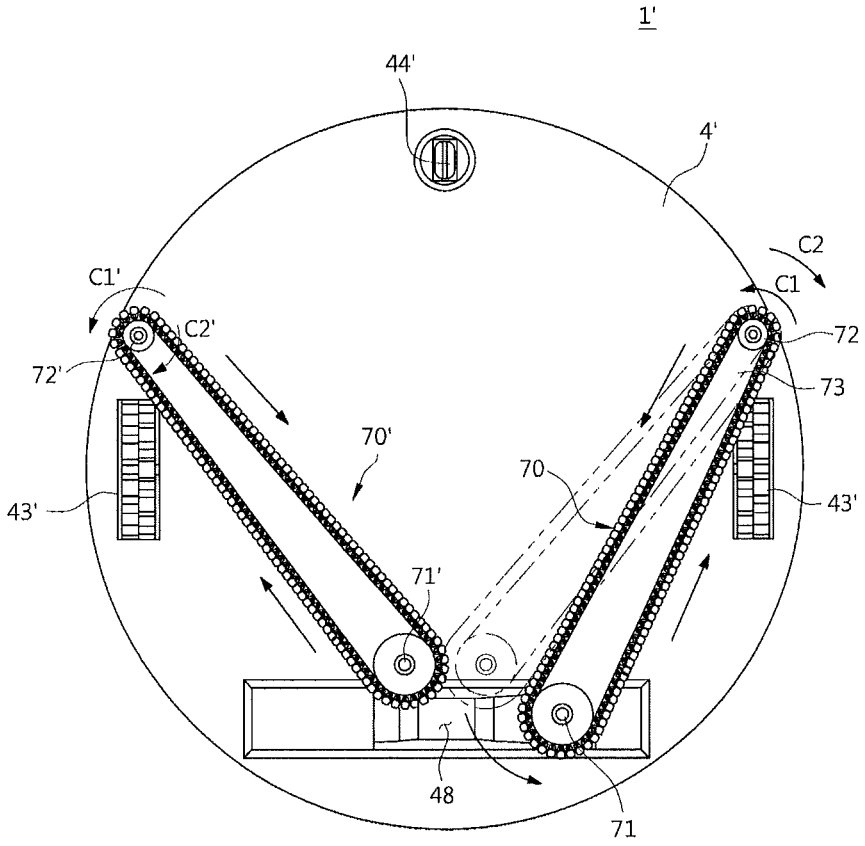
FIG. 10 shows a bottom view of a robot cleaner according to another embodiment of the present disclosure.

FIG. 10 shows a bottom view of a robot cleaner according to another embodiment of the present disclosure.

Referring to FIG. 10, a robot cleaner 1' in accordance with another embodiment of the present disclosure may include a base 4' with cleaning tools arranged in the bottom of the base 4', with one ends of the cleaning tools movable.

Similar to the robot cleaner 1 as described above, the cleaning tools may include a first cleaning tool having an end located on the side of an inlet 48 and the other end extending to a right front side of the base 4' and a second cleaning tool having an end located on the side of the inlet 48 and the other end extending to a left front side of the base 4'. In order for the robot cleaner 1' to pick up foreign materials in a wide area of the floor while running, the other ends of the first and second cleaning tools may be arranged to be apart to the greatest extent from each other within the base 4'.

One ends of the first and second cleaning tools located adjacent to each other may be spaced apart around or near the inlet 48. Foreign materials that lie ahead of the robot cleaner 1' may be absorbed through the inlet 48 located between one ends of the first and second cleaning tools. A distance between one ends of the first and second cleaning tools may be configured to be variable. The area of the inlet 48 may be configured to get wider as well as the distance between one ends of the first and second cleaning tools gets larger.

With this configuration, even if a relatively large foreign material lies ahead of the robot cleaner 1', the robot cleaner 1' may absorb the foreign material through the inlet 48 which is widened, without being interfered with by the cleaning tools.

The cleaning tools may be brush assemblies 30 and 30' arranged in a conveyor belt style. The brush assemblies 70 and 70' may include a first brush assembly 70 and a second brush assembly 70'. One ends of the first and second brush assemblies 70 and 70' are arranged to be adjacent to each other, while the other ends of them are arranged to be apart from each other, thus substantially forming the shape of 'V', which is similar to the case of the robot cleaner 1 as described above.

The first and second brush assemblies 70 and 70' may each be arranged to have a variable position on the base 4' not to interfere with foreign materials lying ahead of the robot cleaner 1'.

Since the structure of the second brush assembly 70' is similar to that of the first brush assembly 70, only the structure of the first brush assembly 70 will be described herein.

The first brush assembly 70 may include pulleys 71 and 72 connected to some motors, and a belt 74. The belt 74 may be wound and rotated around the pulleys 71 and 72. A brush 75 may be attached to and rotated with the belt 74.

The pulleys 71 and 72 includes a first pulley 71 and a second pulley 72. The first and second pulleys 71 and 72 may be installed on a plate 73. The first pulley 71 is installed at one end of the plate 73 while the second pulley 72 is installed at the other end of the plate 73.

The plate 73 may be arranged in the bottom of the base 4' such that the first pulley 71 is located on the side of the inlet 48 formed in the bottom of the base 4' and the second pulley 72 is located adjacent to a right point on the outer circumference of the base 4'.

The second pulley 72 may be rotationally attached to the base 4'. The second pulley 72 may be rotated in one direction while fixed at a particular position adjacent to the outer circumference of the base 4'. The second pulley 72 may be rotated counterclockwise and thus the belt 74 wound around the second pulley 72 may be rotated counterclockwise as well. While the belt 74 is rotated counterclockwise, the brush 75 attached to the belt 74 may pick up and gather foreign materials on the floor to the inlet 48.

The first pulley 71 may be rotated counterclockwise together with the second pulley 72. At least one of the first and second pulleys 71 and 72 may be rotated by receiving driving power from a driving source included in the main body 2. For example, the first pulley 71 may be passively rotated counterclockwise by the belt 74 rotated counterclockwise by the second pulley 72, without receiving driving power.

The first pulley 71 may be arranged as a free end. Specifically, the first pulley 71 may not be fixed to a particular point in the bottom of the base 4' but arranged to have a variable position on the base 4'. If the first pulley 71 is fixed to the plate 73, an end of the plate 73 at which the first pulley 71 is located may be arranged to be the free end while the other end at which the second pulley 71 is located may be arranged as a stationary end fixed to a particular point on the base 4'.

The first brush assembly 70 may be arranged to be moved by being pressed by a foreign material that lies ahead. For example, the first brush assembly 70 may be arranged to be rotated around the second pulley 72 by being pressed by a foreign material. While the first brush assembly 70 is rotated around the second pulley 72, the position of the first pulley 71 may be changed on the base 4'. The plate 73 may be rotated around the second pulley 72 located at an end of the plate 73, and the first pulley 71 located at the other end of the plate 73 may be moved along the circumference centered on the second pulley 72 from around the center of the inlet 48 to an outer side.

The second brush assembly 70' may be arranged to be similar to the first brush assembly 70. That is, the second brush assembly 70' may be arranged such that the first pulley 71' is rotated along the circumference centered on the second pulley 72'.

Although an embodiment where the first and second pulleys 71 and 72 are installed on the single plate 73 has been described above, the structure of the first brush assembly 70 is not limited thereto.

In a case that the first and second pulleys 71 and 72 are not installed on the plate 73, the first pulley 71 may be arranged to be rotated along a part of the circumference centered on the second pulley 72 not to let the belt 74 wound around the first and second pulleys 71 and 72 loose.

For example, one end of the first brush assembly 70 is arranged to be a free end while the other end is arranged to be a stationary end, and the one end of the first brush assembly 70 is arranged to be moved along a part of the circumference centered on the stationary end.

Figure 11A:
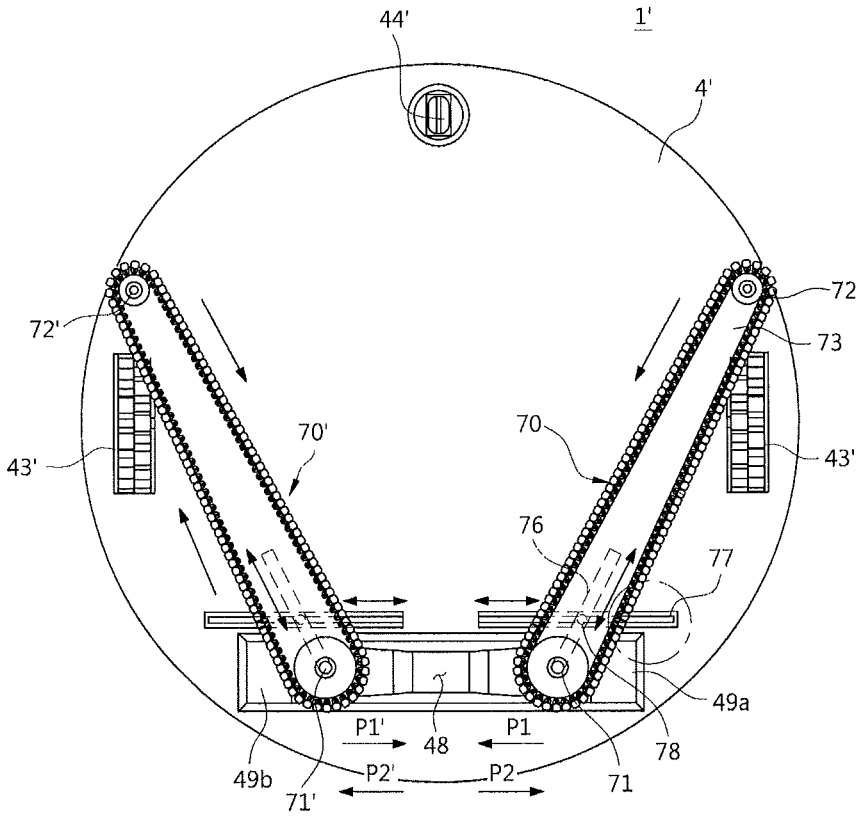
FIG. 11A shows an inlet widened by rotation of brush assemblies of a robot cleaner according to another embodiment of the present disclosure.
Figure 11B:
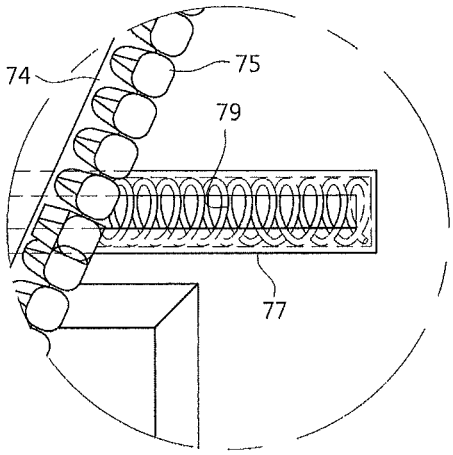
FIG. 11B shows a part of a second rail unit of a robot cleaner according to another embodiment of the present disclosure.

FIG. 11A shows an inlet widened by rotation of brush assemblies of a robot cleaner according to another embodiment of the present disclosure, and FIG. 11B shows a part of a second rail unit of a robot cleaner according to another embodiment of the present disclosure.

Referring to FIGS. 11A and 11B, a rail unit to guide movements of the first pulley 71 is arranged on the bottom of the base 4'. While the first brush assembly 70 is rotated around the second pulley 72, the first brush assembly 70 may be moved by being guided along the rail unit. An elastic member may further be included to apply elastic force to the first brush assembly 70 to be rotated counterclockwise C1 around the second pulley 72 only when a foreign material that lies ahead of the running robot cleaner 1 has a greater diameter than the distance between the first and second brush assemblies 70 and 71 on the side of the inlet 48. After the foreign material having a greater diameter than the distance between the first and second brush assemblies 70 and 71 is absorbed through the inlet 48, the first brush assembly 70 may be rotated clockwise C2around the second pulley 72 and return to the original position due to the elastic force of the elastic member.

The elastic member applies the elastic force to a part including the first pulley 71 of the first brush assembly 70 to be located adjacent to the center of the inlet 48. When the first brush assembly 70 is pressed by a foreign material that lies ahead of the first brush assembly 70, the first brush assembly 70 may be rotated counterclockwise C1around the second pulley 72.

When the first brush assembly 70 is rotated counterclockwise C1around the second pulley 72, the gap between the first and second brush assemblies 70 and 70' may get bigger. The gap between the first and second brush assemblies 70 and 70' remains the same at the second pulleys 72 and 72' but may get bigger as the first and second assemblies 70 and 70' get near the first pulleys 71 and 71'.

Once the foreign material is absorbed through the inlet 48 and thus the force to press the first brush assembly 70 disappears, the first brush assembly 70 may be rotated clockwise C1around the second pulley 72 to the original position of the rotation to be located around the center of the inlet 48, due to the elastic force of the elastic member.

Similar to the case of the first brush assembly 70, when pressed by a foreign material that lies ahead of the second brush assembly 70', the second brush assembly 70' may be rotated clockwise C2' around the second pulley 72'. While the second brush assembly 70 is rotated clockwise C2', the gap between the first and second brush assemblies 70 and 70' in the inlet 48 gets bigger. Once the foreign material is absorbed through the inlet 48 and thus the force to press the second brush assembly 70' disappears, the second brush assembly 70' may return to the original position of the rotation to be located around the center of the inlet 48, due to the elastic force of the elastic member.

An embodiment of a structure of the rail unit to guide movements of the rotating first brush assembly 70 will now be described.

Figure 12:
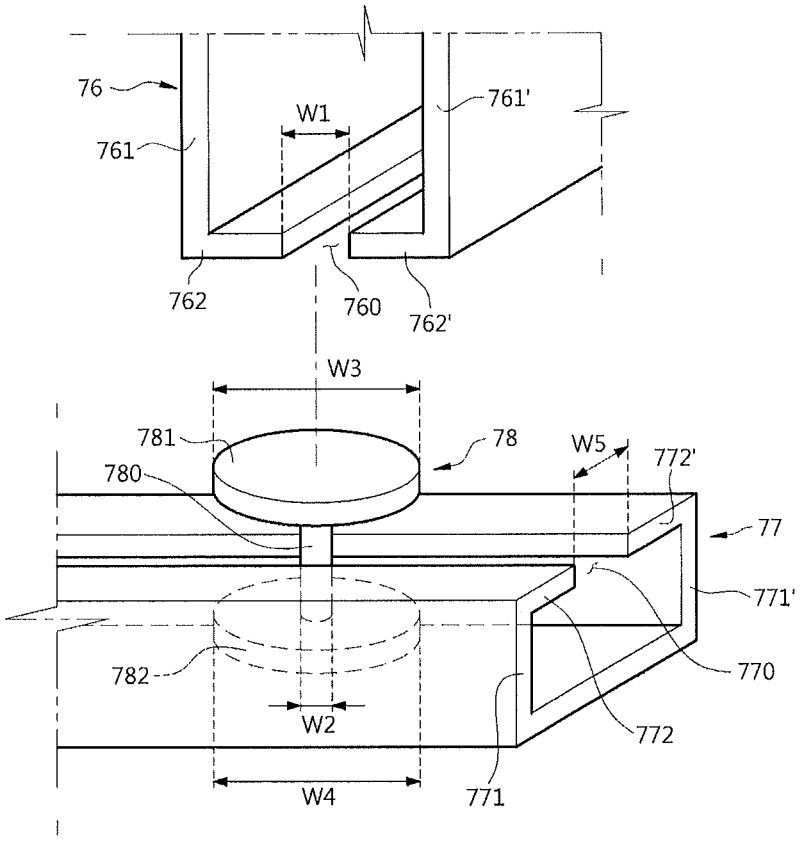
FIG. 12 shows rail units of a robot cleaner according to another embodiment of the present disclosure.

FIG. 12 shows rail units of a robot cleaner according to another embodiment of the present disclosure.

Referring to FIG. 12, a rail unit in accordance with an embodiment of the present disclosure may include a first rail unit 76 arranged at one side of the first brush assembly 70 and a second rail unit 77 arranged on the bottom face of the base 4'. The first rail unit 76 may extend in the direction in which the first brush assembly 70 extends. The second rail unit 77 may be arranged to extend in the left and right directions.

The first brush assembly 70 may move across a plane parallel to the base 4'. Assuming that in the plane where the first and second pulleys 71 and 72 of the first brush assembly 70 are located, the horizontal direction corresponding to a direction in which the inlet 48 extends is called X direction and a direction perpendicular to the X direction is called Y direction, movements of the first pulley 71 of the first brush assembly 70 may be divided into movements in the X direction and movements in the Y direction.

The first rail unit 76 may be arranged to guide both movements in X and Y directions, and the second rail unit 77 may be arranged to guide the movement in the X direction. With the first and second rail units 76 and 77, the first pulley 71 may move both in X and Y directions.

The first and second rail units 76 and 77 may be linked by a connection member 78. One end of the connection member 78 may be positioned to be able to slide in the first rail unit 76 and the other end may be positioned to be able to slide in the second rail unit 77. When the first brush assembly 70 is rotated around the second pulley 72, the connection member 78 may move in the X direction along the second rail unit 77 and the position of the connection member 78 may be variable within the first rail unit 76.

The connection member 78 may include a first head unit 781 positioned to be able to slide in the first rail unit 76 and a second head unit 782 positioned to be able to slide in the second rail unit 77. The first and second head units 781 and 782 may be connected by a connection unit 780. Diameters W3and W4of the first and second head units 781 and 782, respectively, may be arranged to be greater than a diameter W2of the connection unit 780.

The first rail unit 76 may extend along at least a part of a straight line that connects centers of the first and second pulleys 71 and 72 of the first brush assembly 70. The first rail unit 76 may be arranged on a face of the plate 73.

The first rail unit 76 may include first guiding units 761 and 761' mounted on the plate 73 and second guiding units 762 and 762' bent from the first guiding unit 761. Two first guiding units 761 and 761' arranged to face each other may be mounted on the plate 73, and the second guiding units 762 and 762' may be bent such that their cross sections face each other.

An opening 760 may be formed between the second guiding units 762 and 762'. The width W1of the opening 760 may be formed to be greater than the diameter W2of the connection unit 780 and smaller than the diameter W3 of the first head unit 781. The first head unit 781 may be bound by the second guiding units 762 and 762' not to deviate from the first rail unit 76.

The second rail unit 77 may be arranged to have a similar structure to that of the first rail unit 76. The second rail unit 77 may be arranged to extend to a side of the base 4' in the X direction. The second rail unit 77 may include first guiding units 771 and 771' mounted on a face of the base 4' and second guiding units 772 and 772' bent from the first guiding units 771 and 771'. The second guiding units 772 and 772' may be bent for their cross sections to face each other.

An opening 770 may be formed between the second guiding units 772 and 772'. The width W5 of the opening 770 may be formed to be greater than the diameter W2of the connection unit 78 and smaller than the diameter W4of the second head unit 782. The second head unit 782 may be bound by the second guiding units 772 and 772' not to deviate from the second rail unit 77.

With this structure, as the first brush assembly 70 is rotated around the second pulley 72, the connection member 78 may be guided by the second rail unit 77 to move in the horizontal direction, i.e., in the X direction, and does not interfere with movements of the first brush assembly 70 because the position of the connection member 78 may be variable.

The first brush assembly 70 may receive an elastic force from the elastic member 79 for a part where the first pulley 71 is located to head for the center of the inlet 48. For example, the elastic member 79 may be included in the second rail unit 77 and apply an elastic force to the connection member 78 to be located around the center of the inlet 48. The elastic member 79 may be included in the first rail unit 76 or the second rail unit 77.

Similar to the first brush assembly 70, the second brush assembly 70' may also receive an elastic force from the elastic member to be located around the center of the inlet. For example, an end of the first brush assembly 70 may be located around the center of the inlet 48 by receiving the right-to-left elastic force, and an end of the second brush assembly 70' may be located around the center of the inlet 48 by receiving the left-to-right elastic force.

If the diameter of a foreign material that lies ahead of the first and second brush assemblies 70 and 70' while the robot cleaner 1 is running greater than a distance between the first and second brush assemblies 70 and 70', the first and second brush assemblies 70 and 70' may be pressed to the right and the left, respectively, by the foreign material. The first brush assembly 70 may be rotated around the second pulley 72, but the movement of the first brush assembly 70 may not be interfered because the connection member 78 is guided by the first and second rail units 76 and 77.

For example, as for the first brush assembly 70, if it is pressed by a foreign material ahead, the connection member 78 may move along the second rail unit 77 toward the outer circumference of the base 4' and the position of the connection member 78 in the first rail unit 76 may be shifted to the upper right side. Similarly, as for the second brush assembly 70, due to a foreign material that lies ahead, the connection member may be moved along the second rail unit toward the outer circumference of the base and the position of the connection member may be shifted to the upper left side.

As such, pressed by a foreign material ahead, the first and second brush assemblies 70 and 70' may each be rotated around its own second pulley and spaced apart on the side of the inlet 48. Accordingly, the inlet 48 located between the first and second brush assemblies 70 and 70' may be secured widely. Through the widely secured inlet 48, a large-diameter foreign material may be absorbed.

Figure 13:
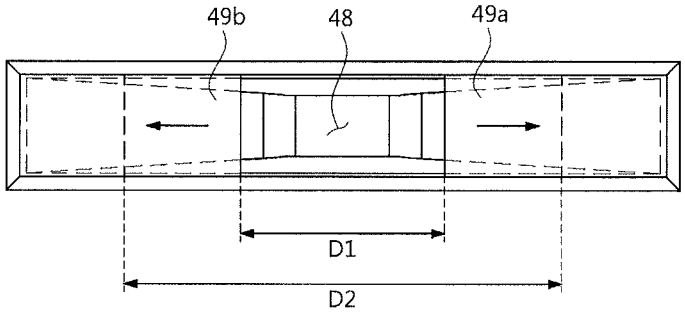
FIG. 13 shows an inlet of a robot cleaner according to another embodiment of the present disclosure.

FIG. 13 shows an inlet of a robot cleaner according to another embodiment of the present disclosure.

Referring to FIG. 13, the inlet 48 of the robot cleaner 1' in accordance with another embodiment may be opened or shut by doors 49*a* and 49*b*. The doors 49*a* and 49*b* may include a first door 49*a* that moves in sync with the movement of the first brush assembly 70 and a second door 49*b* that moves in sync with the movement of the second brush assembly 70'.

Again, the first door 49*a* may be arranged to move in sync with the movement of the first brush assembly 70. More specifically, the first door 49*a* may move in the X-direction in sync with the movement of the first brush assembly 70. The second door 49*b* may move in the X-direction in sync with the second brush assembly 70'.

Assuming that a distance between the first door 49*a* and the second door 49*b* is D1when no external force is applied to the first and second brush assemblies 70 and 70', when the first brush assembly 70 or the second brush assembly 70' is pressed by a foreign material, the first door 49*a* is shifted to the right P2and the second door 49*b* is shifted to the left P2', and thus the distance between the first and second doors 49*a* and 49*b* may be D2, which is larger than D1. The distance D2 between the first and second doors 49*a* and 49*b* may be equal to or greater than the diameter of the foreign material to be absorbed through the inlet 48.

If the foreign material that lies ahead of the robot cleaner 1 is not that big, the distance between the first and second doors 49*a* and 49*b* may remain to be D1to absorb the foreign material. Otherwise, if the foreign material that lies ahead of the robot cleaner 1 has a large diameter, the doors 49*a* and 49*b* may be moved to the right and left, respectively, until the distance becomes D2. Thus, the area of the inlet 48 is expanded and the large-diameter foreign material may be absorbed through the expanded inlet 48.

As such, foreign materials having diameters smaller than D1may be absorbed through the inlet 48 between the doors 49*a* and 49*b* without interference of the brush assemblies 70 and 70', and foreign materials having diameters bigger than D1may press the brush assemblies 70 and 70' to widen the distance between the brush assemblies 70 and 70' on the side of the inlet 48. The doors 49*a* and 49*b* may move to the right and left, respectively, in sync with the brush assemblies 70 and 70', thus widening the distance between the doors 49*a* and 49*b* as much as the diameter of the foreign material to absorb the foreign material through the inlet 48 between the doors 49*a* and 49*b*.

As the inlet 48 is arranged to have a variable area, foreign materials having diameter smaller than D1may be absorbed through the inlet 48 with a high suction force, while foreign materials having diameter bigger than D1may be absorbed through the inlet 48 widened to fit the diameter of the foreign materials without being interfered with by the brush assemblies 70 and 70'.

After the foreign materials having a big diameter is absorbed, the first and second brush assemblies 70 and 70' may return to their original positions due to an elastic force of the elastic member. Together with the first and second brush assemblies 70 and 70', the doors 49*a* and 49*b* may return to their original positions until the distance between the doors 49*a* and 49*b* is D1. Specifically, the first door 49*a* is moved to the left P1 and the second door 49*b* is moved to the right P1', until the distance between them is D1.

As such, with the movable brush assemblies 70 and 70', a foreign material having a diameter bigger than the distance between the brush assemblies 70 and 70' may be swept toward the inlet 48 without interference of the brush assemblies 70 and 70'. With the doors 49*a* and 49*b* that is shifted in sync with the movement of the brush assemblies 70 and 70', the area of the inlet 48 is changeable, and thus a large-diameter foreign material may be absorbed through the widened inlet 48. A relatively small foreign material may be absorbed through the narrowed inlet 48, which may increase suction force and thus improve cleaning performance.

While it has been described that both of the first and second brush assemblies are arranged to be movable by an external force and the first and second doors are moved in sync with movements of the first and second brush assemblies, one of the first and second brush assemblies may be arranged to be movable and thus one of the first and second doors may be moved in sync with the one of the first and second brush assemblies in other embodiments. Structures of the connection member and the rail units that guide movements of the first and second brush assemblies are not limited to what has been described above. It is also possible that the roller brush is arranged to be movable by an external force on the bottom of the main unit.

According to the present disclosure, with a cleaning tool, which integrates functions of side brushes and a main brush into one, arranged on the bottom of the robot cleaner in the shape of 'V', dust or things on the floor may be effectively gathered around an inlet. A guide is arranged on the side of the inlet for gathered dust or things to be absorbed at a center part of the inlet with a high sucking force. The cleaning tool may be arranged to be movable such that a large-diameter foreign material may be absorbed through the inlet without being interfering with by the cleaning tool. The inlet may have an open area widened or narrowed by doors moved in sync with the cleaning tool.

Several embodiments have thus been described with respect to a robot cleaner, but it will be understood that various modifications can be made without departing the scope of the present disclosure. Thus, it will be apparent to those ordinary skilled in the art that the disclosure is not limited to the embodiments described, but can encompass not only the appended claims but the equivalents.

What is claimed is:

1. A robot cleaner comprising:

a main unit having a bottom surface that, when the robot cleaner is positioned on a surface to be cleaned, is parallel to the surface to be cleaned, the main unit including a fan motor and a dust collector, and having an inlet arranged in the bottom surface of the main unit; and a cleaning tool arranged on the bottom of the main unit, wherein, in reference to a Cartesian coordinate system having an origin at the inlet and a straight, forward travel direction of the robot cleaner defining a y-axis of the Cartesian coordinate system, the cleaning tool has an elongated shape extending under the bottom surface of the main unit from a front side of the inlet to a front side of the main unit so that the cleaning tool extends at an acute angle from the y-axis in a first or second quadrant of the Cartesian coordinate system, the cleaning tool thereby being under the bottom surface when the robot cleaner is positioned on the surface to be cleaned, to guide foreign materials that are under the robot cleaner and on the surface to be cleaned to the inlet.

2. The robot cleaner of claim 1, wherein the cleaning tool has one end located on the front side of the inlet and the other end located at a point adjacent to an outer circumference of the main unit.

3. The robot cleaner of claim 1, wherein the cleaning tool is arranged to be movable by an external force pressing on the cleaning tool as the robot cleaner cleans the surface.

4. The robot cleaner of claim 3, further comprising:

a door for the inlet, and which moves in sync with the cleaning tool.

5. The robot cleaner of claim 4, wherein when a side of the cleaning tool moves toward an outer side of the bottom of the main unit, the door moves with the cleaning tool to expand the inlet.

6. The robot cleaner of claim 1, wherein the cleaning tool comprises:

a first cleaning tool that extends from the front side of the inlet to a left front side of the main unit to guide foreign materials that are under the robot cleaner and on the surface to be cleaned to the inlet; and a second cleaning tool that extends from the front side of the inlet to a right front side of the main unit to guide foreign materials that are under the robot cleaner and on the surface to be cleaned to the inlet.

7. The robot cleaner of claim 1, wherein the cleaning tool comprises a brush assembly including a belt with a brush attached to the belt.

8. The robot cleaner of claim 7, wherein the brush assembly includes a first pulley arranged on the front side of the inlet and a second pulley arranged on the front side of the main unit, and wherein the belt is rotated while being wound around the first and second pulleys.

9. The robot cleaner of claim 7, further comprising:

pulleys around which the belt is wound and which cause the belt to be rotated, wherein the belt includes a first part and a second part, the first part is between the second part and a center of the bottom of the main unit, and, as the belt is rotated, the first part moves from the front side of the main unit to the inlet.

10. The robot cleaner of claim 9, wherein the robot cleaner is movable along the surface to clean the surface, and the belt is arranged to be tilted so that the second part does not contact the surface as the robot cleaner moves along the surface to clean the surface.

11. The robot cleaner of claim 10, wherein belt contacts of the pulleys are each arranged to be tilted at an angle to face an outer side of the main unit.

12. The robot cleaner of claim 10, wherein a part of the brush attached to the belt is located inside the inlet.

13. The robot cleaner of claim 1, wherein the cleaning tool is a blade formed of a flexible rubber material.

14. The robot cleaner of claim 13, wherein an outer face of the blade is coated or has irregularities in order to easily capture foreign materials on the surface.

15. The robot cleaner of claim 13, wherein a slit is formed on the bottom surface, which is located above the blade, for air discharged from the dust collector to pass through.

16. The robot cleaner of claim 1, wherein the cleaning tool comprises a roller brush with a spiral brush attached onto an outer circumference of the cleaning tool.

17. The robot cleaner of claim 1, wherein the inlet has a suction path partitioned by a guide to smoothly absorb foreign materials guided by the cleaning tool.

18. A robot cleaner comprising:

a main unit having an inlet in a bottom surface of the main unit;

a fan motor arranged in the main unit for producing a suction force to, while the robot cleaner is positioned on a surface to be cleaned by the robot cleaner, cause air and foreign materials that are under the robot cleaner and on the surface to be cleaned to be absorbed through the inlet;

a dust collector to separate the absorbed foreign materials from the absorbed air, and to keep the separated foreign materials; and multiple cleaning tools arranged on, and extending under, the bottom surface of the main unit, and thereby being under the bottom surface when the robot cleaner is positioned on the surface to be cleaned, to guide the foreign materials that are under the robot cleaner and on the surface to be cleaned to the inlet, wherein a shortest distance between a respective cleaning tool of the multiple cleaning tools and an adjacent cleaning tool of the multiple cleaning tools that is adjacent to the respective cleaning tool gets farther as the respective cleaning tool and the adjacent clean tool become farther away from the inlet, the inlet thereby being positioned at a vertex of the respective cleaning tool and the adjacent cleaning tool.

19. The robot cleaner of claim 18, wherein the respective cleaning tool has first and second ends with the second end being closer to the inlet than the first end, the adjacent cleaning tool has first and second ends with the second end being closer to the inlet than the first end, and the respective cleaning tool and the adjacent cleaning tool are configured so that an external force pressing on at least one of the respective cleaning tool and the adjacent cleaning tool as the robot cleaner cleans the surface causes the second end of the respective cleaning tool and the second end of the adjacent cleaning tool to become farther away from each other.

20. The robot cleaner of claim 19, wherein at least one of the first end of the respective cleaning tool and the first end of the adjacent cleaning tool is arranged to be rotated around a rotation axis so that the external force thereby causes the second end of the respective cleaning tool and the second end of the adjacent cleaning tool to become farther away from each other.

21. The robot cleaner of claim 19, wherein the main unit includes an elastic member to apply an elastic force to at least one of the respective cleaning member and the adjacent cleaning tool, and wherein if the external force disappears, a distance between the second end of the respective cleaning tool and the second end of the adjacent cleaning tool returns to an original state due to the elastic member.

22. The robot cleaner of claim 21, wherein:

the second end of the respective cleaning tool is located on a side of the inlet and the first end of the respective cleaning tool is located on a right front side of the main unit; and the second end of the adjacent cleaning tool is located on the side of the inlet and the first end of the adjacent cleaning tool is located on a left front side of the main unit.

23. The robot cleaner of claim 22, wherein the respective cleaning tool and the adjacent cleaning tool are arranged to be symmetrical to each other.

24. The robot cleaner of claim 18, further comprising:

a door for the inlet, and which moves in sync with at least one of the respective cleaning tool and the adjacent cleaning tool.

25. The robot cleaner of claim 24, wherein an area of the inlet is expanded or reduced by movement of the door.

26. The robot cleaner of claim 18, wherein the respective cleaning tool and the adjacent cleaning tool form a substantially V-shape, and the vertex is a vertex of the substantially V-shape.

27. A robot cleaner comprising:

a main unit including a fan motor and a dust collector and having an inlet arranged in a bottom of the main unit; and first and second cleaning tools arranged on the bottom of the main unit to, while the robot cleaner moves along a surface to be cleaned, guide foreign materials on the surface to the inlet, wherein the first cleaning tool extends from a side of the inlet to a right front side of the main unit and the second cleaning tool extends from the side of the inlet to a left front side of the main unit, and at least one of the first and second cleaning tools is arranged to be rotated, in a plane parallel to the surface while the robot cleaner moves along the surface, around a rotation axis when pressed by a foreign material on the surface that lies between the first and second cleaning tools.

28. The robot cleaner of claim 27, further comprising:

a door for the inlet, and which expands or reduces an area of the inlet by moving in sync with the first or second cleaning tool.

29. The robot cleaner of claim 28, wherein the door expands an open area of the inlet when said at least one of the first and second cleaning tools is rotated around the rotation axis.

30. The robot cleaner of claim 27, further comprising:

an elastic member to apply an elastic force to said at least one of the first and second cleaning tools so that, when said at least one of the first and second cleaning tools is no longer pressed by the foreign material, said at least one of the first and second cleaning tools rotates in an opposite direction than which said at least one of the first and second cleaning tools was rotated when pressed by the foreign material.

31. The robot cleaner of claim 27, wherein each of the first and second cleaning tools comprises a brush assembly having a brush attached onto an outer circumference of a belt.

32. The robot cleaner of claim 31, wherein the belt is arranged to be tilted such that a part of the brush assembly that moves from a rear of the robot cleaner to a front of the robot cleaner does not contact the surface while the robot cleaner moves along the surface.

33. The robot cleaner of claim 27, wherein each of the first and second cleaning tools comprises a roller brush with a spiral brush attached onto an outer circumference of the respective cleaning tool.

34. The robot cleaner of claim 27, wherein:

the side of the inlet is a front side of the inlet, the first cleaning tool has an elongated shape extending from the front side of the inlet to the right front side of the main unit at an acute angle from a straight, forward travel direction of the robot cleaner, and the second cleaning tool has an elongated shape extending from the front side of the inlet to the left front side of the main unit at an acute angle from the straight, forward travel direction of the robot cleaner.

35. A robot cleaner comprising:

a bottom surface;

an inlet on the bottom surface; and first and second elongated cleaning tools which, when the robot cleaner is positioned on a surface to be cleaned, contact the surface as the robot cleaner travels along the surface to clean the surface, wherein the first and second elongated cleaning tools extend under the bottom surface and are positioned with respect to each other to form a shape having a vertex, with the inlet being positioned at the vertex, so that, as the robot cleaner travels in a forward travel direction to clean the surface, foreign materials under the robot cleaner and on the surface between the first and second elongated cleaning tools are funneled by the first and second elongated cleaning tools into the inlet.

36. The robot cleaner claim 35, wherein:

the inlet has a front side corresponding to a front of the robot cleaner, the first elongated cleaning tool extends at least from the front side of the inlet toward a right front side of the robot cleaner, and the second elongated cleaning tool extends at least from the front side of the inlet toward a left front side of the robot cleaner.

37. The robot cleaner of claim 36, wherein the shape is a substantially V-shape.

38. The robot cleaner of claim 36, wherein:

the first elongated cleaning tool has a first end and a second end, the first end being positioned in the right front side of the robot cleaner near a periphery of the robot cleaner, and the second end being on the front side of the inlet or over the inlet, and the second elongated cleaning tool has a first end and a second end, the first end being positioned in the left front side of the robot cleaner near a periphery of the robot cleaner, and the second end being on the front side of the inlet or over the inlet.

39. The robot cleaner of claim 36, wherein the first and second elongated cleaning tools are brush assemblies.

40. The robot cleaner of claim 35, wherein the shape is a substantially V-shape.

41. The robot cleaner of claim 40, wherein the first and second elongated cleaning tools are brush assemblies.

42. A robot cleaner comprising:

a main unit including a fan motor and a dust collector, and having an inlet arranged in a bottom of the main unit;

a cleaning tool arranged in the bottom of the main unit, extending to a front side of the main unit from a side of the inlet, to guide foreign materials on a surface to be cleaned to the inlet, and being movable by an external force pressing on the cleaning tool as the robot cleaner cleans the surface; and a door for the outlet, and which moves in sync with the cleaning tool so that, when a side of the cleaning tool moves toward an outer side of the bottom of the main unit, the door moves with the cleaning tool to expand the inlet.

43. A robot cleaner comprising:

a main unit including a fan motor and a dust collector, and having an inlet arranged in a bottom of the main unit; and a cleaning tool arranged in the bottom of the main unit, extending to a front side of the main unit from a side of the inlet, to guide foreign materials on a surface to be cleaned to the inlet, wherein the cleaning tool is a blade, and a slit is formed on a bottom face of the main unit, which is above the blade, for air discharged from the dust collector to pass through.

* * * * *